United States Patent [19]

Taplin et al.

[11] Patent Number: 4,987,823

[45] Date of Patent: Jan. 29, 1991

[54] LOCATION OF PISTON POSITION USING RADIO FREQUENCY WAVES

[75] Inventors: Lael B. Taplin, Union Lake; Calman S. Sagady, West Bloomfield, both of Mich.

[73] Assignee: Vickers, Incorporated, Troy, Mich.

[21] Appl. No.: 377,051

[22] Filed: Jul. 10, 1989

[51] Int. Cl.[5] ..... F15B 13/16

[52] U.S. Cl. ..... 91/361; 92/5 R; 324/635; 324/644

[58] Field of Search ..... 91/1, 275, 361, 392, 91/419, 459; 92/5 R; 324/635, 644

[56] References Cited

U.S. PATENT DOCUMENTS

| | | | |
|---|---|---|---|
| 3,589,177 | 6/1971 | Merlo | 324/644 |
| 4,588,953 | 5/1986 | Krase | 324/644 |
| 4,737,705 | 4/1988 | Bitar et al. | 324/635 |
| 4,749,936 | 6/1988 | Taplin | 91/361 |
| 4,757,745 | 7/1988 | Taplin | 91/361 |

*Primary Examiner*—Edward K. Look
*Assistant Examiner*—F. Daniel Lopez
*Attorney, Agent, or Firm*—Barnes, Kisselle, Raisch, Choate, Whittemore & Hulbert

[57] ABSTRACT

An electrohydraulic control system includes an actuator having a cylinder and a piston variably positionable therewithin. An electrohydaulic valve is responsive to valve control signals for coupling the actuator to a source of hydraulic fluid. A coaxial transmission line extends through the actuator, and includes an outer conductor formed by the actuator cylinder and a center conductor operatively coupled to the piston, such that length of the coaxial transmission line is effectively directly determined by position of the piston within the cylinder. An rf generator is coupled to the coaxial transmission line for launching rf energy therewithin, and valve control electronics is responsive to rf energy reflected by the coaxial transmission line for indicating position of the piston within the cylinder and generating electronic control signals to the valve. A second coaxial transmission line of fixed length is connected the valve and actuator so that the hydraulic fluid flows therethrough. The rf energy is launched in the second transmission line and generator frequency is controlled as a function of phase angle at the second transmission line.

29 Claims, 2 Drawing Sheets

LOCATION OF PISTON POSITION USING RADIO FREQUENCY WAVES

The present invention is directed to position measuring devices, and more particularly to apparatus for determining position of an actuator piston in an electrohydraulic valve and actuator system.

BACKGROUND AND OBJECTS OF THE INVENTION

In electrohydraulic valve control systems that embody a valve coupled to a hydraulic actuator, it is desirable to monitor position of the actuator piston for purposes of closed-loop servo control. U.S. Pat. No. 4,749,936 discloses an electrohydraulic valve control system in which a coaxial transmission line is formed within the actuator to include a center conductor coaxial with the actuator and an outer conductor. A bead of ferrite or other suitable magnetically permeable material is magnetically coupled to the piston and surrounds the center conductor of the transmission line for altering impedance characteristics of the transmission line as a function of position of the piston within the cylinder. Position sensing electronics includes an oscillator coupled to the transmission line for launching electromagnetic radiation, and a phase detector responsive to radiation reflected from the transmission line for determining position of the piston within the actuator cylinder. In a preferred embodiment, the coaxial transmission line includes a tube, with a centrally-suspended center conductor and a slidable bead of magnetically permeable material, projecting from one end of the actuator cylinder into a central bore extending through the opposing piston. In another embodiment, the outer conductor of the transmission line is formed by the actuator cylinder, and the center conductor extends into the piston bore in sliding contact therewith as the piston moves axially of the cylinder. The systems so disclosed provide improved economy and performance as compared with previous devices for a similar purpose, but are susceptible to temperature variations within the actuator, and consequent changes in properties of the dielectric material within the transmission line.

U.S. Pat. No. 4,757,745 discloses an electrohydraulic valve control system that includes a variable frequency rf generator coupled through associated directional couplers to a pair of antennas that are positioned within the actuator cylinder. The antennas are physically spaced from each other in the direction of piston motion by an odd multiple of quarter-wavelengths at a nominal generator output frequency. A phase detector receives the reflected signal outputs from the directional couplers, and provides an output through an integrator to the frequency control input of the generator to automatically compensate frequency of the rf energy radiated to the cylinder, and thereby maintain electrical quarter-wave-length spacing between the antennas, against variations in dielectric properties of the hydraulic fluid due to changes in fluid temperature, etc. A second phase detector is coupled to the generator and to one antenna for generating a piston position signal. The output of the second phase detector is responsive to phase angle of energy reflected from the piston and provides a direct real-time indication of piston position to the valve control electronics. Although the disclosed system thus addresses the problem of temperature-induced variations in electrical properties of the hydraulic fluid, a problem remains in that temperature compensation is essentially confined to fluid in the volume immediately surrounding and between the antennas, and thus does not take into consideration temperature and temperature gradients in the hydraulic fluid throughout the cylinder.

A general object of the present invention, therefore, is to provide apparatus for determining position of a piston within an electrohydraulic actuator that is inexpensive to implement, that is adapted to continuously monitor motion in real-time, that is accurate to a fine degree of resolution, and that is reliable over a substantial operating lifetime. Another object of the invention is to provide apparatus of a described character that automatically compensates for variations in dielectric properties of the hydraulic fluid due to temperature variations and gradients, etc. throughout the entire cylinder.

A further object of the invention is to provide a coaxial transmission system that embodies enhanced capability for matching impedance of a transmission line to impedance of the energy-launching antenna and associate circuitry.

Yet another object of the invention is to provide a system of general utility for monitoring position of a piston within a cylinder, and having particularly application for monitoring piston position in an electrohydraulic servo valve and actuator system of the character described.

SUMMARY OF THE INVENTION

An electrohydraulic control system in accordance with the invention includes an actuator, such as a linear or rotary actuator, having a cylinder and a piston variably positionable therewithin. An electrohydraulic valve is responsive to valve control signals for coupling the actuator to a source of hydraulic fluid. A coaxial transmission line extends through the actuator, and includes an outer conductor formed by the actuator cylinder and a center conductor operatively coupled to the piston, such that length of the coaxial transmission line is effectively directly determined by position of the piston within the cylinder. An rf generator is coupled to the coaxial transmission line for launching rf energy therewithin, and valve control electronics is responsive to rf energy reflected by the coaxial transmission line for indicating position of the piston within the cylinder and generating electronic control signals to the valve.

In a preferred embodiment of the invention, a second coaxial transmission line of fixed length is connected to the valve and actuator so that the hydraulic fluid flows therethrough. RF energy is launched in the second coaxial transmission line, and reflected energy is compared with the generator output to identify variations do solely to changes in dielectric properties of the fluid. Output frequency of the rf generator is controlled as a function of such reflected energy, specifically as a function of a phase difference between the reflected energy and the generator output. In one embodiment of the invention, the second coaxial transmission line is fixedly mounted within the actuator cylinder and extends into a central bore in the piston, with the outer conductor of the second coaxial transmission line also functioning as the center conductor of the first coaxial transmission line. In another embodiment of the invention, the second coaxial transmission line is positioned separately from the actuator.

Apparatus for monitoring position of a piston within a cylinder in accordance with the invention thus comprises a coaxial transmission line in which the outer conductor is formed by the cylinder, and the center conductor is operatively coupled to the piston so that length of the coaxial transmission line is determined directly by position of the piston within the cylinder. Preferably, rf energy is capacitively coupled to the center conductor of the coaxial transmission line by a stub antenna that extends radially into the cylinder. In accordance with the coaxial transmission line system provided by the invention, stub tuning screws extend radially into the transmission line adjacent to the antenna for matching impedance characteristics of the transmission line to those of the antenna and the associated circuitry.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
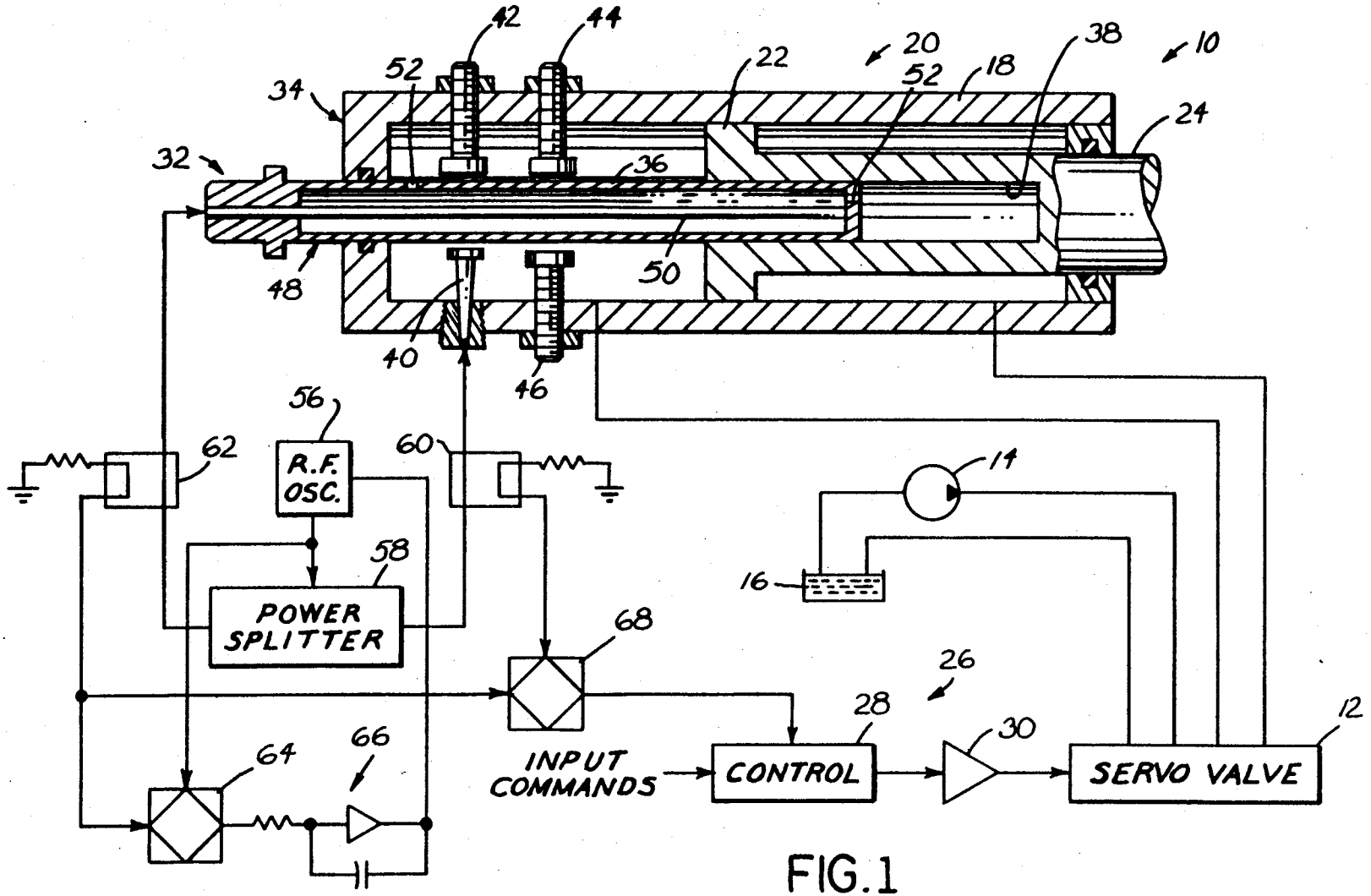
FIG. 1 is a schematic diagram of an electrohydraulic valve and actuator control system that features piston position monitoring circuitry in accordance with a presently preferred embodiment of the invention.

FIG. 1 illustrates an electrohydraulic control system 10 as comprising an electrohydraulic servo valve 12 having a first set of inlet and outlet ports connected through a pump 14 to a source 16 of hydraulic fluid, and a second set of ports connected to the cylinder 18 of a linear actuator 20 on opposed sides of the actuator piston 22. Piston 22 is connected to a rod 24 that extends through one axial end wall of cylinder 18 for connection to an actuator load (not shown). Servo electronics 26 includes control electronics 28, preferably microprocessor-based, that receives input commands from a master controller or the like (not shown) and provides a pulse width modulated drive signal through an amplifier 30 to servo valve 12. Piston monitoring apparatus 32 in accordance with the present invention is responsive to actuator piston 22 for generating a position feedback signal to control electronics 28. Thus, for example, in a closed-loop position control mode of operation, control electronics 28 may provide valve drive signals to amplifier 30 as a function of a difference between the input command signals from a remote master controller and the position feedback signals from position monitoring apparatus 32.

In accordance with a presently preferred embodiment of the invention illustrated in FIG. 1, a first coaxial transmission line 34 is formed by a hollow cylindrical tube 36 that is affixed at one end to the end wall of cylinder 18 remote from piston rod 24, and is slidably received at the opposing end within a central bore 38 extending axially into piston 22 and rod 24. The outer conductor of coaxial transmission line 34 is formed by the wall of cylinder 18 itself, and is electrically connected to the free end of tube 36 by means of capacitive coupling between tube 36 and piston bore 38, and between piston 22 and the inner surface of cylinder 18. A stub antenna 40 is mounted to cylinder 18 adjacent to the fixed end of tube 36, and extends radially inwardly therefrom to terminate at a fixed position adjacent to but radially spaced from the outer surface of tube 36. Three screw-type stub tuners 42, 44, 46 are carried by cylinder 18 and extend radially inwardly therefrom adjacent to stub antenna 40. Specifically, tuner 46 is adjustably carried at a position diametrically opposed to antenna 40, and tuners 44, 46 are adjustably disposed as a diametrically opposed pair between antenna 40 and piston 22.

A second coaxial transmission line 48 is formed by a center conductor rod 50 that extends through tube 36 and is affixed thereto within piston bore 38. Tube 36 thus serves as the outer conductor of coaxial transmission line 48, as well as the inner conductor of coaxial transmission line 34. Coaxial transmission line 48 is of fixed dimension axially of cylinder 18 and includes a plurality of apertures 52 for admitting hydraulic fluid into the hollow interior of tube 36. Apertures 52 are small as compared with oscillator output wavelength. Thus, whereas the electrical properties of coaxial transmission line 34 vary both as a function of position of piston 32 within cylinder 18 and dielectric properties of the hydraulic fluid, the electrical properties of coaxial transmission line 48 vary solely as a function of fluid properties since the transmission line length is fixed.

An rf oscillator 56 generates energy at microwave frequency (e.g., 1 GHz) as a function of signals at an oscillator frequency control input. The output of oscillator 56 is fed to a power splitter 58, which in turn feeds the oscillator output to stub antenna 40 and center conductor 50 of coaxial transmission line 48 through a pair of directional couplers 60, 62. The rf energy at antenna 40 is capacitively coupled to tube 36, and thus launched in coaxial transmission line 34. Stub tuners 42–46 are adjusted to match input impedance of transmission line 34 to impedance of antenna 40 and associated drive circuitry, tuners 44, 46 being symmetrically adjusted and tuner 42 being adjusted independently of tuners 44, 46. The reflected-signal output of directional coupler 62 is connected to one input of a phase detector 64, which receives a second input from the output of oscillator 56. The output of phase detector 64 is connected through an integrator 66 to the frequency control input of oscillator 56. Thus, the output frequency of oscillator 56 is controlled as a function of phase angle of reflected energy at coaxial transmission line 48, which in turn varies solely as a function of fluid dielectric properties since the transmission line length is fixed.

The reflected-signal output of directional coupler 62 is also fed to one input of a second phase detector 68, which receives its second input from the reflected-signal output of directional coupler 60. The output of phase detector 68, which varies as a function of position of piston 22 within cylinder 18 and substantially independently of fluid dielectric properties, provides the piston-position signal to control electronics 28.

Figure 2:
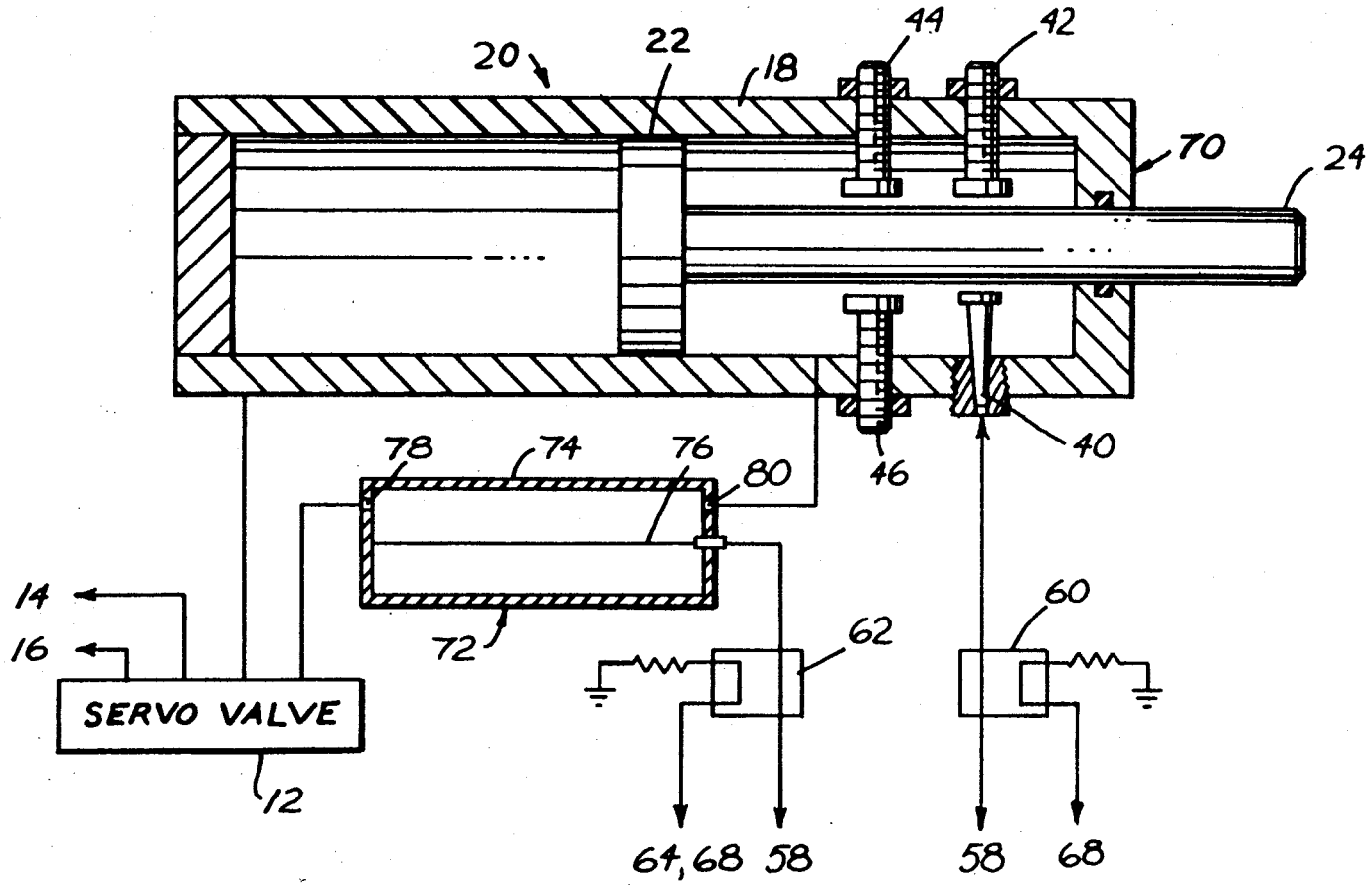
FIG. 2 is a schematic diagram of a second embodiment of the invention.

FIG. 2 illustrates a modified embodiment of the invention in which piston rod 24 cooperates with piston 22 and cylinder 18 of actuator 20 to function as the center conductor of a piston-responsive coaxial transmission line 70. The second transmission line 72, of fixed length and responsive solely to fluid dielectric properties, is positioned externally of actuator 20. In particular, stub antenna 40, which is connected through directional coupler 60 to oscillator 56 and power splitter 58 (FIG. 1), is positioned adjacent to piston rod 24 and capacitively couples energy from the oscillator to the piston shaft. Rod 24 is directly electrically connected to piston 22, which in turn is capacitively coupled to cylinder 18 to form coaxial transmission line 70. Stub tuners 42–46 are positioned adjacent to stub antenna 40 between piston 22 and antenna 40, and function as previously described. Coaxial transmission line 72 comprises a tubular outer conductor 74 having center conductor 76 coaxially mounted therewithin. As in the embodiment of FIG. 1, conductor 76 is connected through directional coupler 62 to oscillator 56 and power splitter 58. The reflected-signal outputs of directional couplers 60, 62 are fed to phase detectors 64, 68 (FIG. 1). Tube 74 has end wall apertures 78, 80 connected between servo valve 12 and actuator 20 for feeding hydraulic fluid through the hollowed interior of tube 74, so that electrical properties thereof vary as a function of fluid dielectric properties as previous described.

The invention claimed is:

1. An electrohydraulic control system that includes an actuator having a cylinder and a piston variably positionable therewithin, electrohydraulic valve means responsive to valve control signals for coupling said actuator to a source of hydraulic fluid, and means responsive to position of said piston within said cylinder for generating said valve control signals, characterized in that said position-responsive means comprises:

a coaxial transmission line extending within said actuator and including an outer conductor formed by said cylinder and a center conductor operatively coupled to said piston such that length of said coaxial transmission line is determined directly by position of said piston within said cylinder, means for launching rf energy within said coaxial transmission line, said energy-launching means including an rf generator, and a stub antenna coupled to said generator and extending radially into said cylinder for capacitively coupling rf energy from said generator to said center conductor, and means responsive to rf energy reflected by said coaxial transmission line for indicating position of said piston within said cylinder.

2. The system set forth in claim 1 wherein said rf generator has a frequency control input, and wherein said energy launching means further includes means responsive to dielectric properties of said hydraulic fluid within said cylinder for providing a control signal to said frequency control input of said generator to automatically compensate frequency of said rf energy for variations in said dielectric properties.

3. The system set forth in claim 1 wherein said energy-launching means further comprises at least one stub tuner extending radially into said cylinder adjacent to said antenna for matching impedance of said coaxial transmission line to said energy-launching means.

4. The system set forth in claim 3 wherein said at least one stub tuner comprises a first tuning screw diametrically opposed to said stub antenna across said cylinder.

5. The system set forth in claim 4 wherein said at least one stub tuner further comprises second and third tuning screws positioned as a pair diametrically opposed to each other across said cylinder adjacent to said antenna.

6. The system set forth in claim 5 wherein all of said first, second and third tuning screws are radially adjustable.

7. The system set forth in claim 6 wherein said second and third tuning screws are positioned between said antenna and said piston.

8. The system set forth in claim 1 wherein said piston has an axial bore formed therein, and wherein said center conductor comprises means fixedly carried within said cylinder and slidably extending into said bore, said cylinder being electrically coupled to said fixedly-carried means within said bore.

9. The system set forth in claim 8 wherein said rf generator has a frequency control input, and wherein said energy-launching further includes means responsive to dielectric properties of said hydraulic fluid within said cylinder for providing a control signal to said frequency control input of said generator to automatically compensate frequency of said rf energy for variations in said dielectric properties so that operating wavelength remains constant.

10. The system set forth in claim 9 wherein said fixedly-carried means comprises a second coaxial transmission line that includes a hollow tube forming said inner conductor electrically coupled to said piston within said bore and a conductive element fixedly suspended within said tube, means in said tube for feeding hydraulic fluid within said cylinder through said tube, means for coupling said generator to said conductive element, and means responsive to phase angle of rf energy reflected at said second coaxial transmission line for providing said frequency control signal.

11. The system set forth in claim 1 wherein said piston is affixed to a piston rod extending from said cylinder, and wherein said stub antenna is positioned adjacent to said piston rod such that said rod forms said inner conductor.

12. The system set forth in claim 11 wherein said rf generator having a frequency control input, and wherein said energy launching means further includes means responsive to dielectric properties of said hydraulic fluid within said cylinder for providing a control signal to said frequency control input of said generator to automatically compensate frequency of said rf energy for variations in said dielectric properties.

13. The system set forth in claim 12 further comprising a second coaxial transmission line of fixed length and including a hollow outer conductor and an inner conductor suspended within said hollow outer conductor, means for feeding hydraulic fluid through said second coaxial transmission line, means for coupling said generator to said second coaxial transmission line, and means responsive to phase angle of rf energy reflected at said second coaxial transmission line for providing said frequency control signal.

14. An electrohydraulic control system that includes an actuator having a cylinder and a piston variably positionable therewithin, electrohydraulic valve means responsive to valve control signals for coupling said actuator to a source of hydraulic fluid, and means responsive to position of said piston within said cylinder for generating said valve control signals, characterized in that said position-responsive means comprises:

an rf generator having a frequency control input, first and second coaxial transmission lines, said first coaxial transmission line being operatively coupled to said actuator such that length thereof varies as a function of position of said piston within said cylinder and said second coaxial transmission line having a fixed length, means for feeding said hydraulic fluid through said second transmission line such that impedance characteristics thereof vary with dielectric properties of said fluid, means for coupling output of said generator to said first and second coaxial transmission lines, and means responsive to phase angle of rf energy reflected at said second coaxial transmission line for providing said frequency control input to said generator.

15. The system set forth in claim 14 wherein said phase-angle-responsive means comprises a phase detector having an output and having inputs coupled to said generator and to said second coaxial transmission line, and an integrator having an input coupled to said output of said phase detector and an output coupled to said control input of said generator.

16. The system set forth in claim 14 wherein said first coaxial transmission line comprises an outer conductor formed by said cylinder, and a center conductor extending through said cylinder and operatively coupled to said piston.

17. The system set forth in claim 16 wherein said piston has an axial bore formed therein, and wherein said center conductor comprises means fixedly carried within said cylinder and slidably extending into said bore, said cylinder being electrically coupled by said piston to said fixedly-carried means within said bore.

18. The system set forth in claim 17 wherein said fixedly-carried means comprises said second coaxial transmission line including a hollow tube forming said center conductor and a conductive element fixedly suspended within said tube, and means in said tube for feeding hydraulic fluid within said cylinder through said tube.

19. The system set forth in claim 16 wherein said piston is affixed to a piston rod extending from said cylinder and forming said center conductor.

20. The system set forth in claim 19 wherein said second coaxial transmission line includes a hollow outer conductor and an inner conductor suspended within said hollow outer conductor, and means for feeding hydraulic fluid through said second coaxial transmission line.

21. The system set forth in claim 16 wherein said energy-launching means comprises a stub antenna coupled to said generator and extending radially into said cylinder for capacitively coupling rf energy from said generator to said center conductor.

22. A system for monitoring position of a piston within a cylinder that comprises:

a coaxial transmission line, including an outer conductor formed by said cylinder and a center conductor operatively coupled to said piston such that length of said coaxial transmission line is determined directly by position of said piston within said cylinder, means for launching rf energy within said coaxial transmission line, said energy-launching means including an rf generator and a stub antenna coupled to said generator and extending radially into said cylinder for capacitively coupling rf energy from said generator to said center conductor, and means responsive to rf energy reflected by said coaxial transmission line for indicating position of said piston within said cylinder.

23. The system set forth in claim 22 wherein said energy-launching means further comprises at least one stub tuner extending radially into said cylinder adjacent to said antenna for matching impedance of said coaxial transmission line to said energy-launching means.

24. The system set forth in claim 23 wherein said at least one stub tuner comprises a first tuning screw diametrically opposed to said stub antenna across said cylinder.

25. The system set forth in claim 24 wherein said at least one stub tuner further comprises second and third tuning screws positioned as a pair diametrically opposed to each other across said cylinder adjacent to said antenna.

26. The system set forth in claim 25 wherein all of said first, second and third tuning screws are radially adjustable.

27. The system set forth in claim 26 wherein said second and third tuning screws are positioned between said antenna and said piston.

28. The system set forth in claim 22 wherein said piston has an axial bore formed therein, and wherein said center conductor comprises means fixedly carried within said cylinder and slidably extending into said bore, said cylinder being electrically coupled to said fixedly-carried means within said bore.

29. The system set forth in claim 22 wherein said piston is affixed to a piston rod extending from said cylinder, and wherein said stub antenna is positioned adjacent to said piston rod such that said rod forms said inner conductor.

* * * * *